US011717097B2

(12) United States Patent
Guyette

(10) Patent No.: US 11,717,097 B2
(45) Date of Patent: Aug. 8, 2023

(54) MOVEABLE BASE FOR RETAIL GONDOLA

(71) Applicant: American Business Forms, Inc., Glenwood, MN (US)

(72) Inventor: Gregory Scott Guyette, St. Petersburg, FL (US)

(73) Assignee: American Business Forms, Inc., Glenwood, MN (US)

( * ) Notice: Subject to any disclaimer, the term of this patent is extended or adjusted under 35 U.S.C. 154(b) by 0 days.

(21) Appl. No.: 17/303,159

(22) Filed: May 21, 2021

(65) Prior Publication Data

US 2021/0361083 A1 Nov. 25, 2021

Related U.S. Application Data

(60) Provisional application No. 62/704,700, filed on May 22, 2020.

(51) Int. Cl.
*A47F 5/10* (2006.01)
*A47F 5/00* (2006.01)

(52) U.S. Cl.
CPC ..... *A47F 5/10* (2013.01); *A47F 5/0018* (2013.01)

(58) Field of Classification Search
CPC ..... A47F 5/10; A47F 5/0018
See application file for complete search history.

(56) References Cited

U.S. PATENT DOCUMENTS 2,483,606 A * 10/1949 Albach ..... A47B 47/03 312/257.1
3,120,199 A * 2/1964 Kolster ..... A47B 57/04 108/6
3,186,668 A * 6/1965 Story ..... A47B 57/425 248/158
3,229,822 A * 1/1966 Janus ..... A47B 57/04 211/134
3,265,419 A * 8/1966 Durnbaugh ..... H05K 5/04 403/219
3,570,798 A * 3/1971 Squibb ..... A47B 96/1441 248/243
3,601,346 A * 8/1971 Fenwick ..... A47F 5/103 248/188.1
5,372,262 A * 12/1994 Benson ..... A47B 47/02 211/189
5,382,087 A * 1/1995 Pouch ..... A47B 43/00 160/135
5,415,302 A * 5/1995 Carlson ..... A47B 55/02 108/147.13
5,433,327 A * 7/1995 Benvenuti ..... A47B 57/42 108/108
5,899,035 A * 5/1999 Waalkes ..... E04B 2/7433 52/239
6,164,467 A * 12/2000 DePottey ..... A47F 5/0846 211/189
6,442,909 B2 * 9/2002 Waalkes ..... A47B 21/06 211/192

(Continued)

*Primary Examiner* — Stanton L Krycinski
(74) *Attorney, Agent, or Firm* — Merchant & Gould P.C.

(57) ABSTRACT

An example base for a retail gondola can include: a frame defining a locator configured to receive a bottom portion of the retail gondola; and a plurality of bolts held by the frame, the plurality of bolts being moveable up and down to position the frame relative to a support surface; wherein a portion of each of the plurality of bolts is configured to allow the frame to be slid along the support surface.

17 Claims, 18 Drawing Sheets

(56) References Cited

U.S. PATENT DOCUMENTS

| | | | | |
|---|---|---|---|---|
| 7,198,160 | B2 * | 4/2007 | Ernst | A47F 5/01 211/126.8 |
| 7,270,242 | B2 * | 9/2007 | Liu | A47B 47/024 211/189 |
| 8,038,021 | B2 * | 10/2011 | Chen | A47B 57/42 211/192 |
| 8,127,948 | B2 * | 3/2012 | Davis | A47F 5/137 211/186 |
| 8,464,878 | B2 * | 6/2013 | Andersen | A47F 1/12 211/150 |
| 8,556,093 | B2 * | 10/2013 | Davis | A47F 5/01 211/187 |
| 8,807,356 | B2 * | 8/2014 | Weigand | A47F 5/10 211/183 |
| 9,127,395 | B2 * | 9/2015 | Kim | D06F 31/00 |
| 9,204,739 | B2 * | 12/2015 | Van Buskirk | A47F 5/16 |
| 9,930,963 | B2 * | 4/2018 | Guizzardi | A47B 91/026 |
| 10,165,854 | B2 * | 1/2019 | Lim | F16B 12/10 |
| 10,660,435 | B2 * | 5/2020 | Miller, Jr. | A47B 57/04 |
| 2003/0173320 | A1 * | 9/2003 | Linney, II | B62B 3/006 211/126.6 |
| 2005/0000924 | A1 * | 1/2005 | Webb | A47F 5/01 211/59.2 |
| 2005/0126448 | A1 * | 6/2005 | Bernstein | B65D 19/44 108/55.1 |
| 2008/0116156 | A1 * | 5/2008 | Park | A47B 87/0207 211/59.2 |
| 2011/0115354 | A1 * | 5/2011 | Blochl | H05K 7/18 312/351.1 |
| 2015/0129528 | A1 * | 5/2015 | Brozak | A47B 47/0033 211/186 |
| 2015/0201755 | A1 * | 7/2015 | Moon | A47B 47/0075 211/153 |

* cited by examiner

MOVEABLE BASE FOR RETAIL GONDOLA

INTRODUCTION

Modular retail gondolas include multiple metal parts that, when assembled, form a display system. This structure is strong under vertical load, but is not easily slid, moved or relocated as it is designed and engineered to remain in its original, assembled location.

SUMMARY

The present disclosure is directed to a base formed beneath a retail gondola for the purpose of making the gondola moveable while assembled and/or stocked.

In one aspect, an example base for a retail gondola can include: a frame defining a locator configured to receive a bottom portion of the retail gondola; and a plurality of bolts held by the frame, the plurality of bolts being moveable up and down to position the frame relative to a support surface; wherein a portion of each of the plurality of bolts is configured to allow the frame to be slid along the support surface.

DETAILED DESCRIPTION

The present disclosure is directed to a base formed beneath a retail gondola for the purpose of making the gondola moveable while assembled and/or stocked.

In example embodiments, the base becomes integral with the gondola. The base is generally hidden discretely beneath the gondola and can be used as to move the gondola as needed, without advance planning, preparation or setup. The accompanying figures depict the base in isolation and installed with a gondola.

Figure 1:
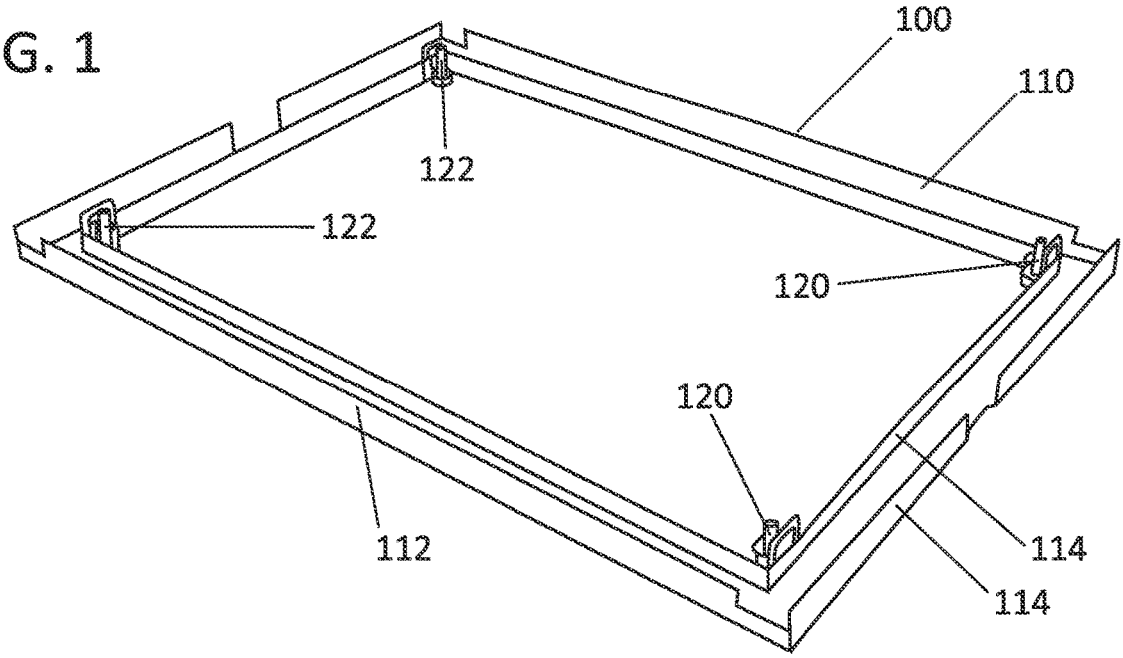
FIG. 1 shows an example base for supporting a retail gondola.
Figure 2:
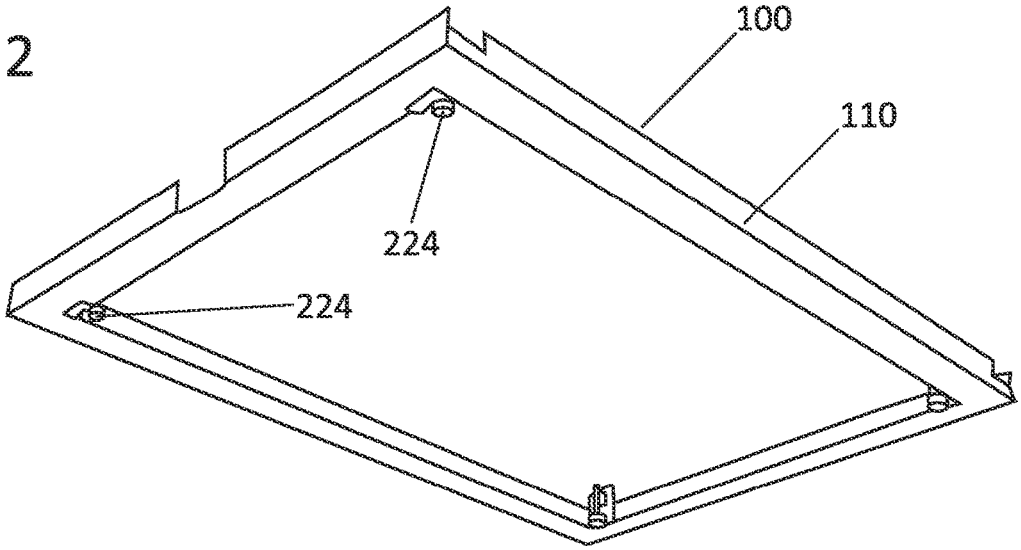
FIG. 2 shows another view of the base of FIG. 1.
Figure 3:
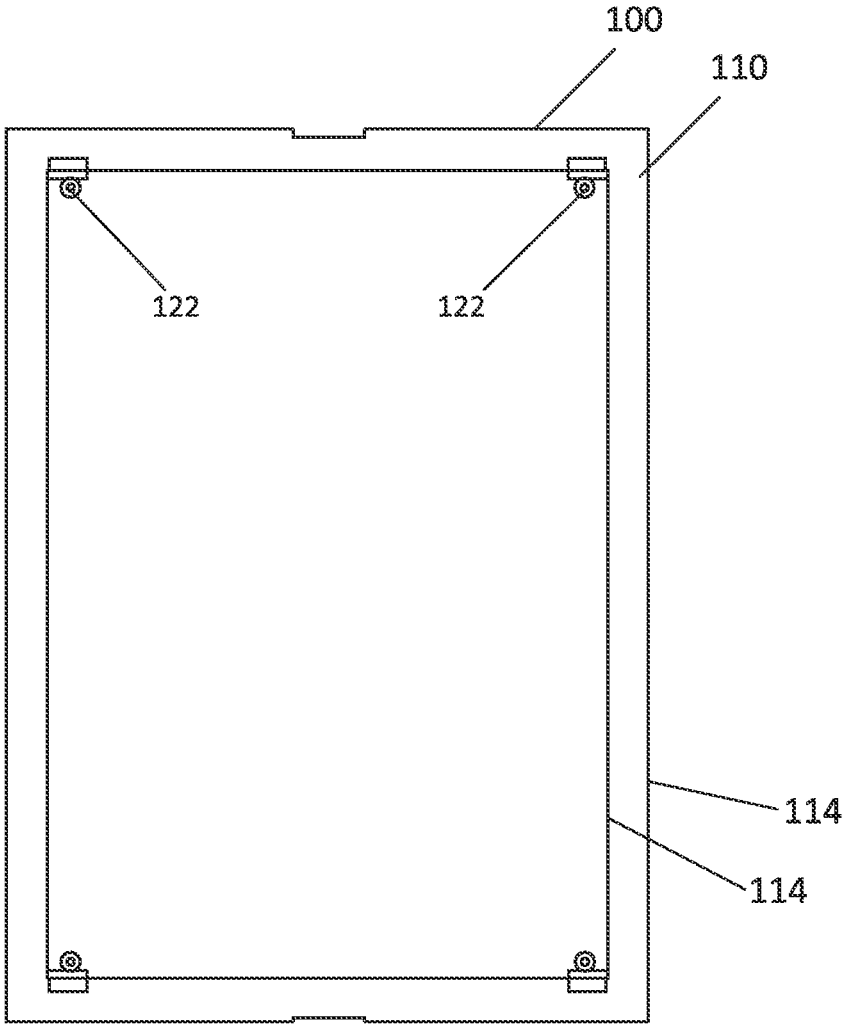
FIG. 3 shows another view of the base of FIG. 1.
Figure 4:
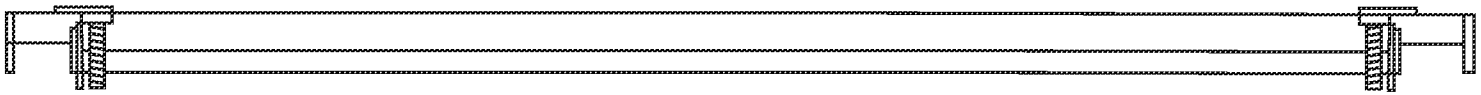
FIG. 4 shows another view of the base of FIG. 1.
Figure 5:
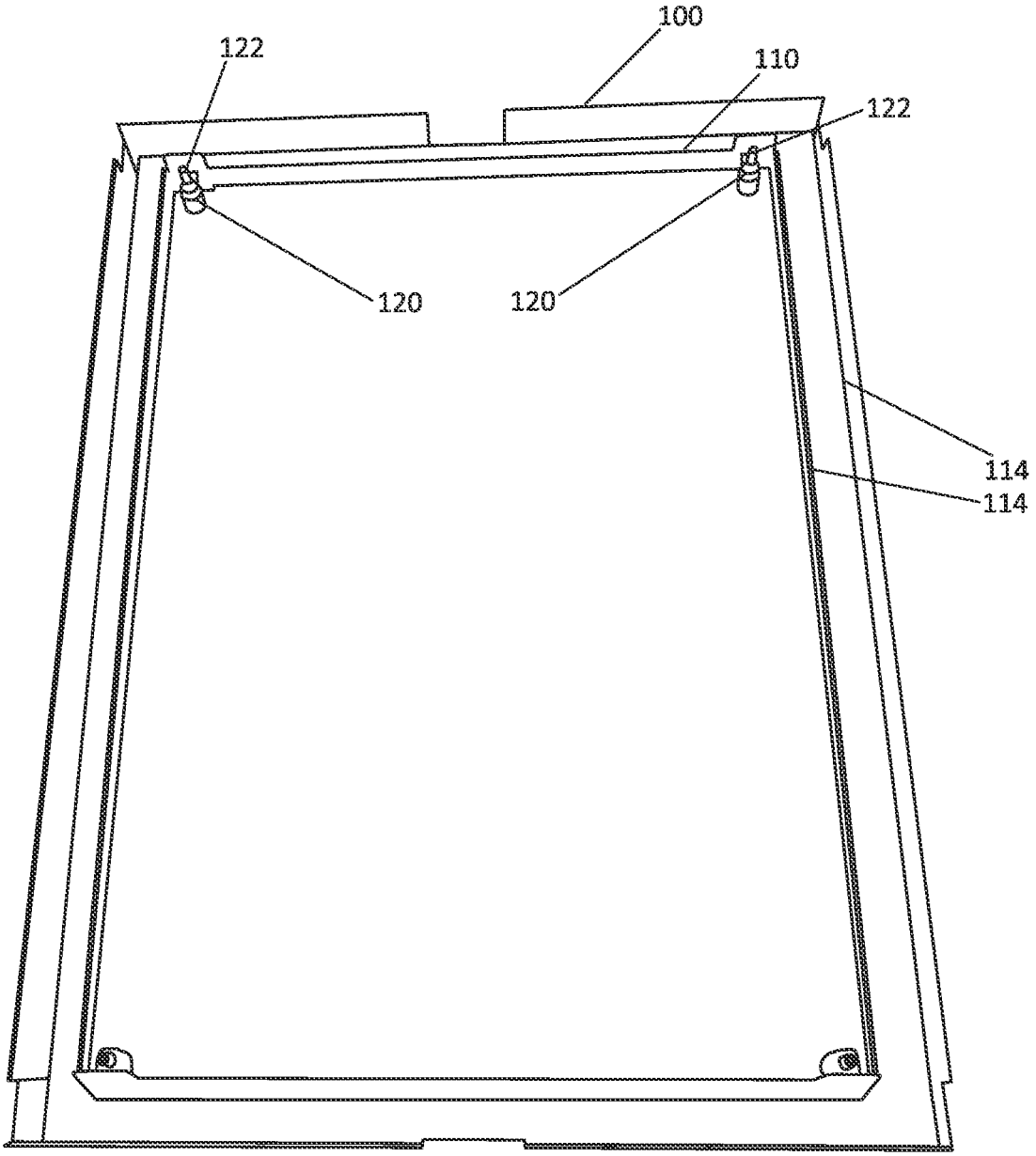
FIG. 5 shows another view of the base of FIG. 1.
Figure 6:
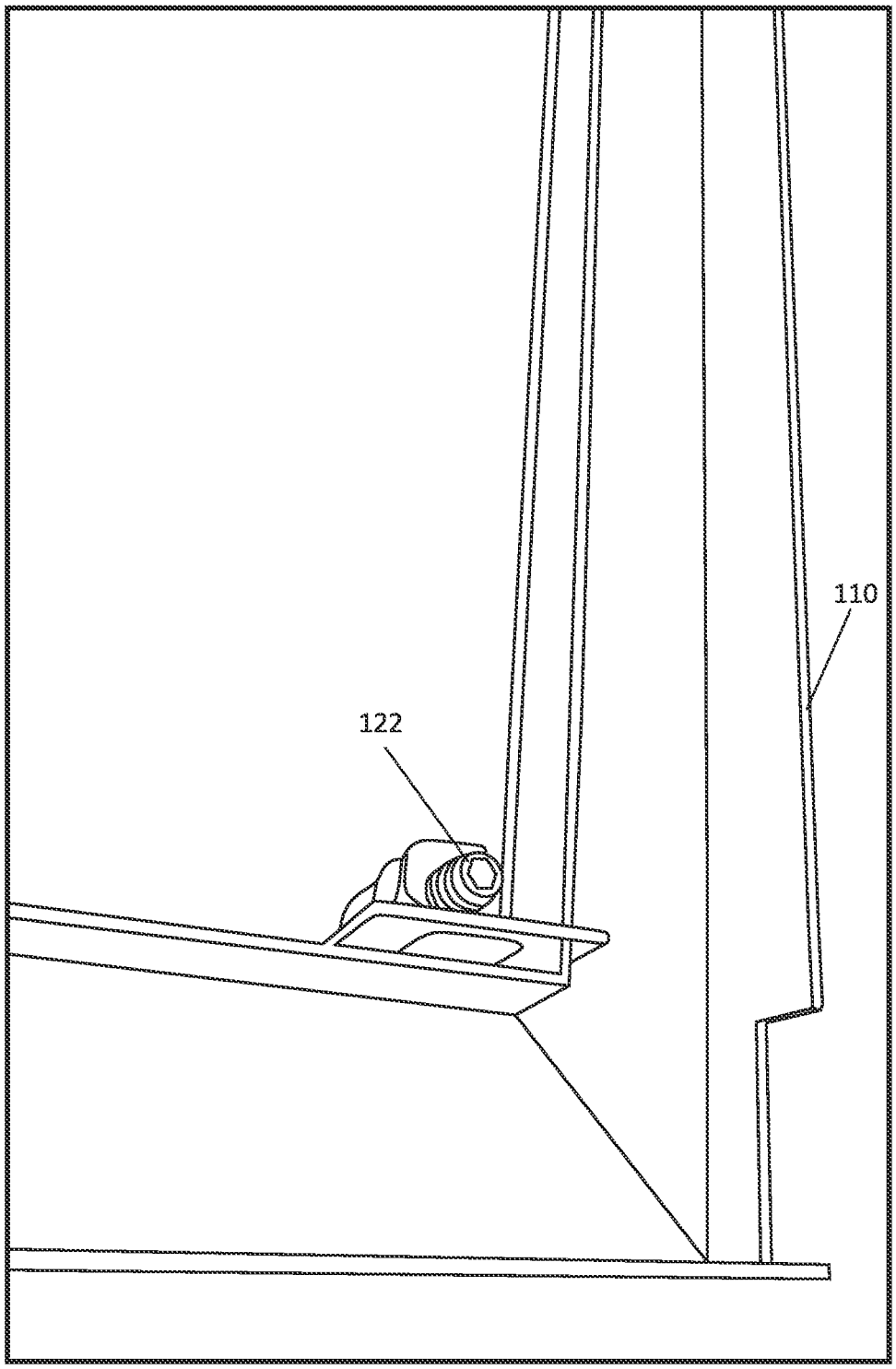
FIG. 6 shows another view of the base of FIG. 1.
Figure 7:
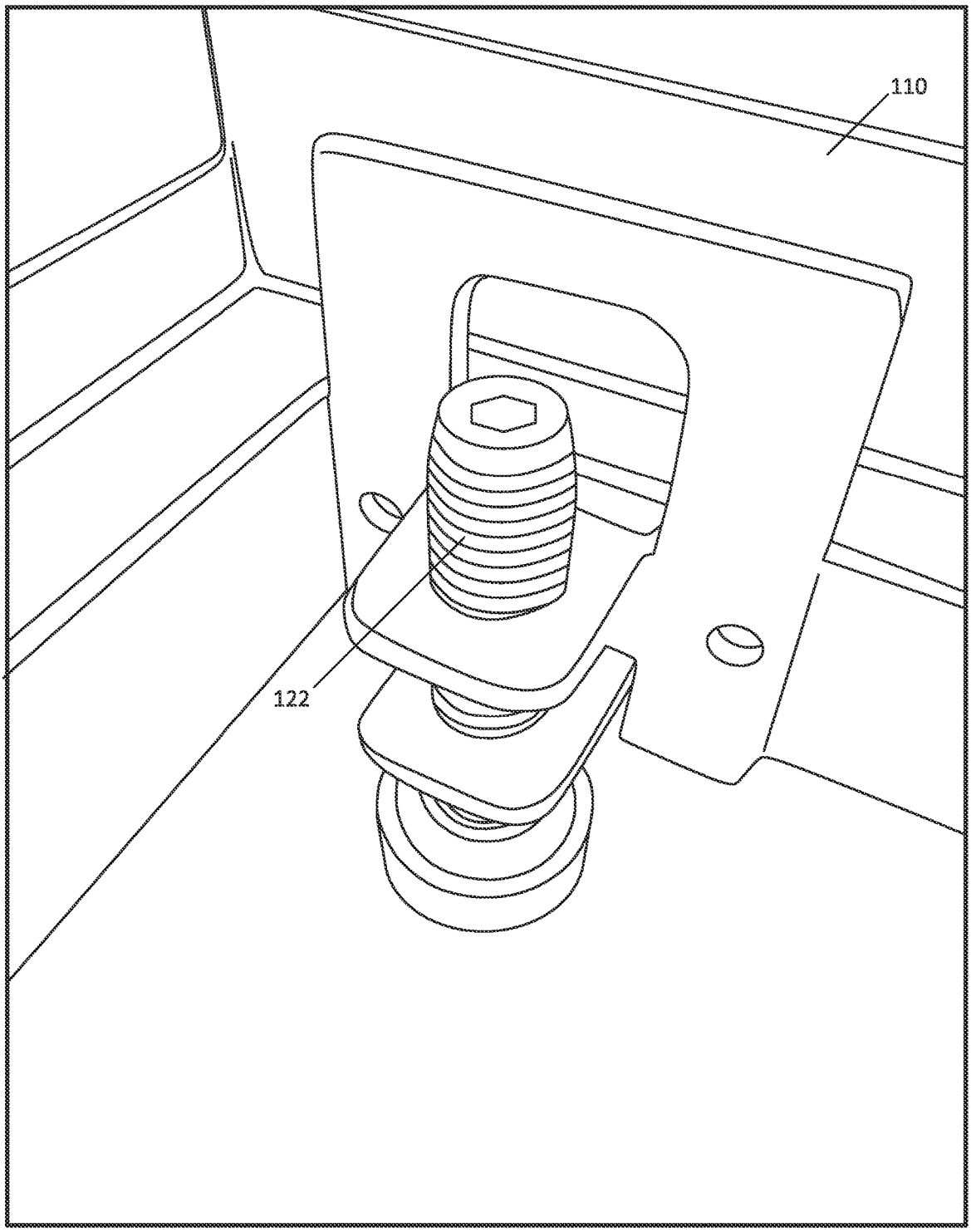
FIG. 7 shows another view of the base of FIG. 1.
Figure 8:
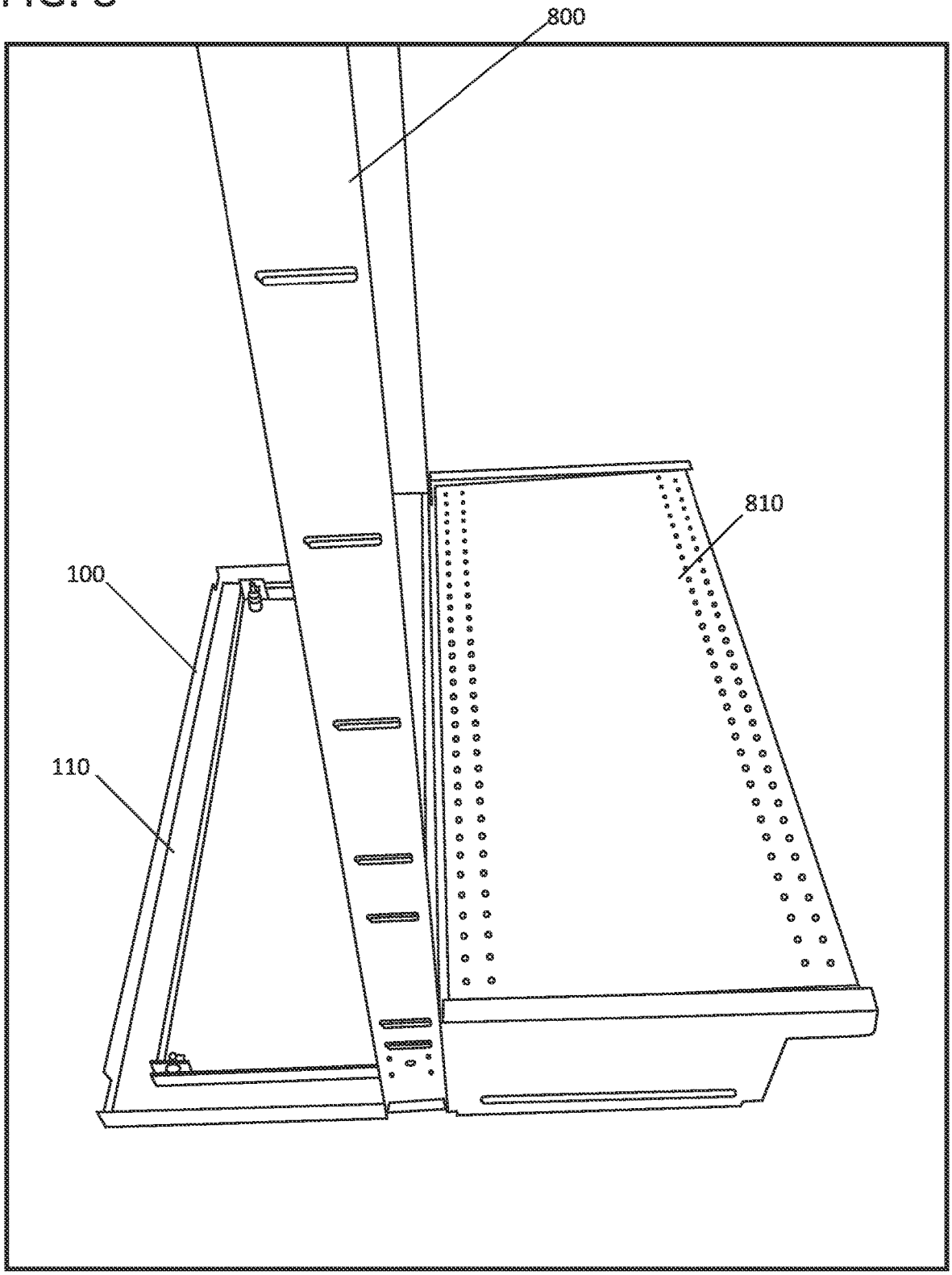
FIG. 8 shows an example gondola positioned on the base of FIG. 1.
Figure 10:
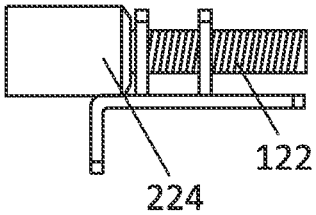
FIG. 10 shows another view of the bolt and eyelet of FIG. 9.
Figure 12:
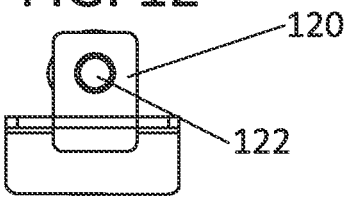
FIG. 12 shows another view of the bolt and eyelet of FIG. 9.
Figure 11:
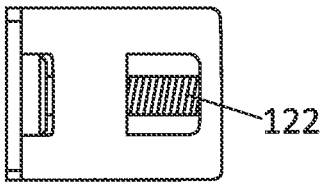
FIG. 11 shows another view of the bolt and eyelet of FIG. 9.
Figure 13:
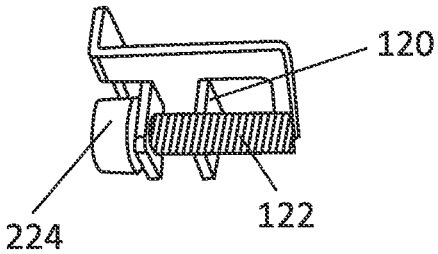
FIG. 13 shows another view of the bolt and eyelet of FIG. 9.
Figure 9:
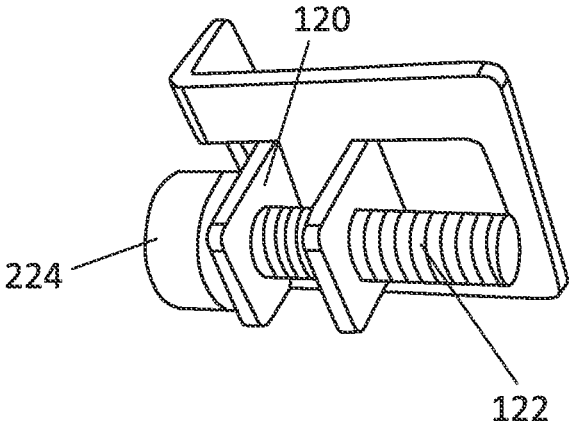
FIG. 9 shows an example bolt and eyelet of the base of FIG. 1.
Figure 14:
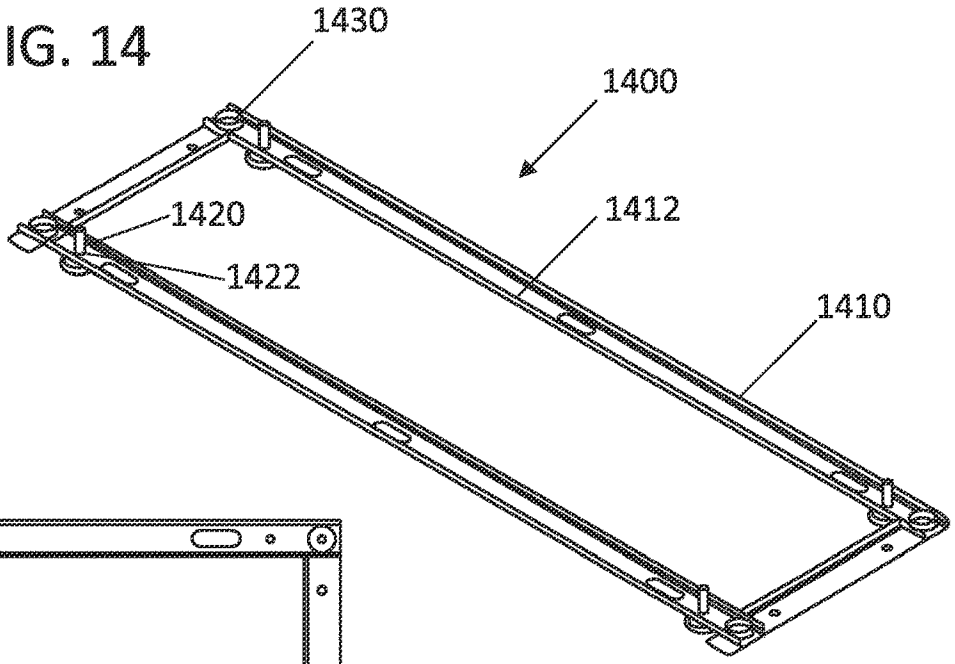
FIG. 14 shows another example base for supporting a retail gondola.
Figure 15:
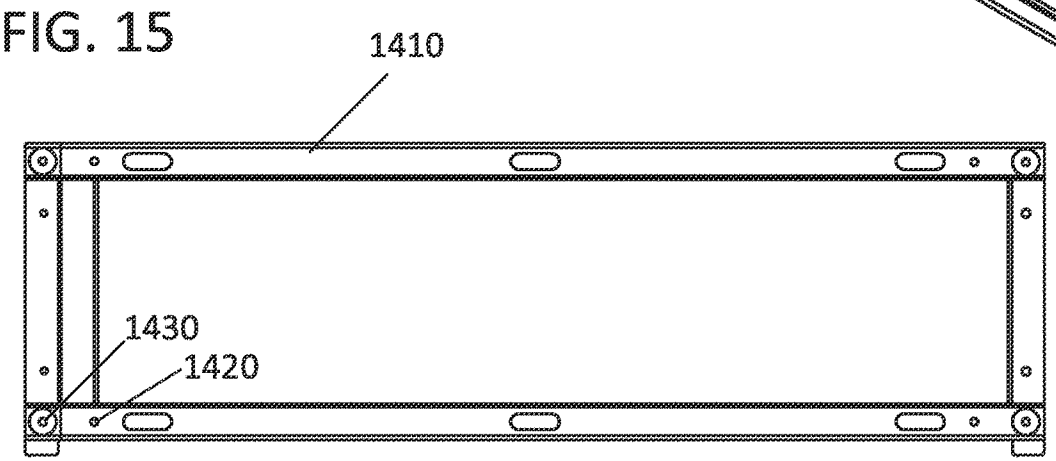
FIG. 15 shows another view of the base of FIG. 14.
Figure 17:
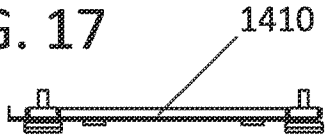
FIG. 17 shows another view of the base of FIG. 14.
Figure 16:
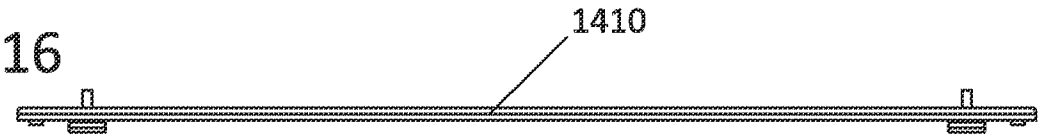
FIG. 16 shows another view of the base of FIG. 14.
Figure 18:
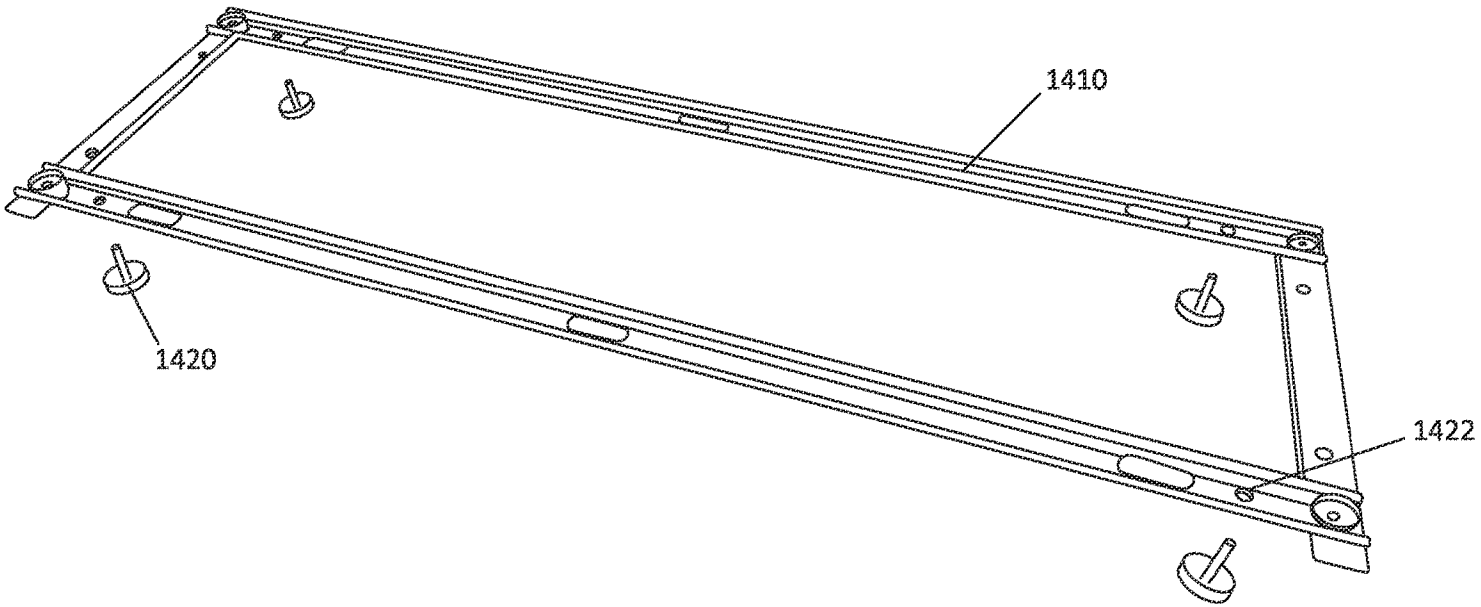
FIG. 18 shows another view of the base of FIG. 14.
Figure 19:
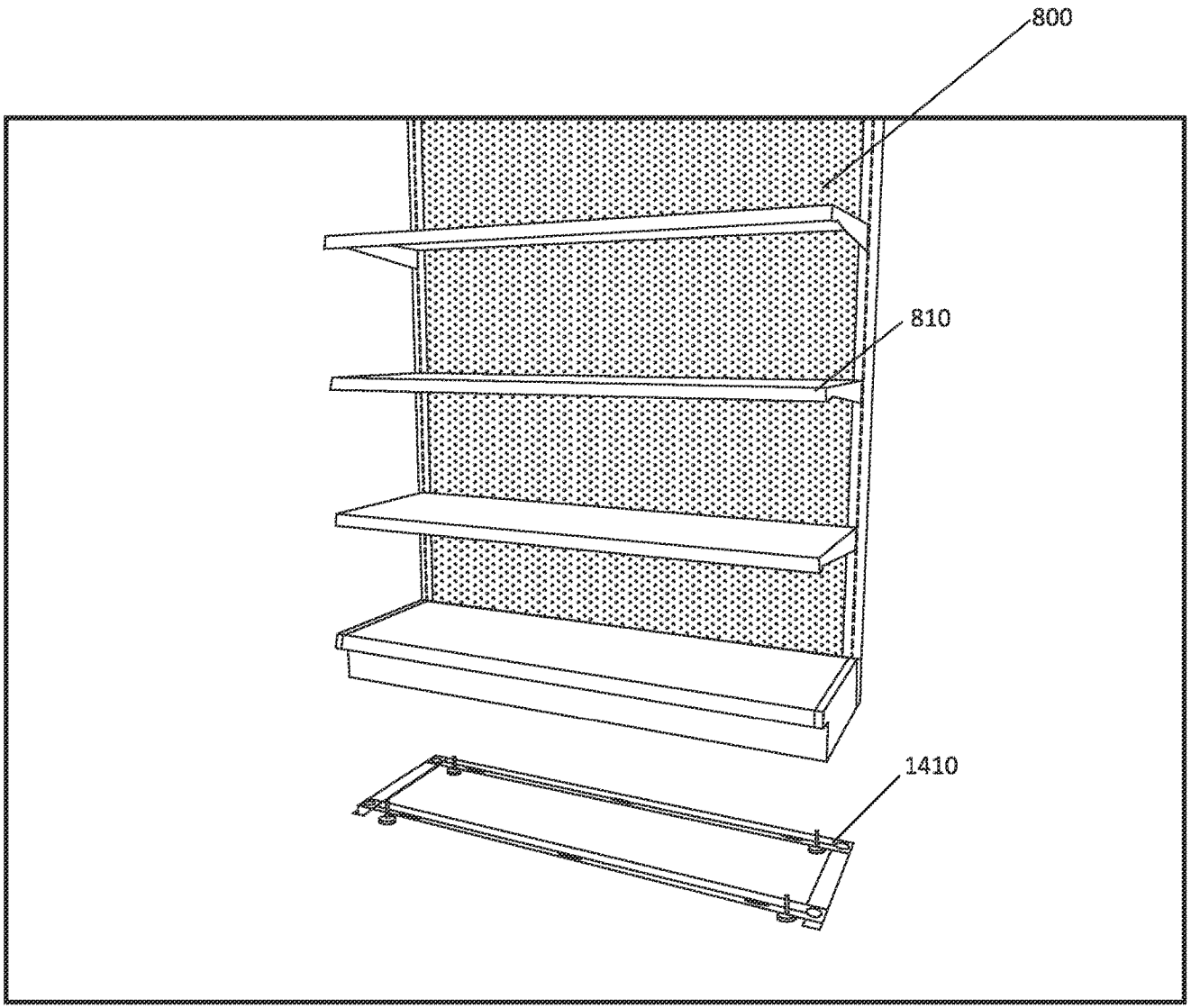
FIG. 19 shows an example gondola positioned on the base of FIG. 14.
Figure 20:
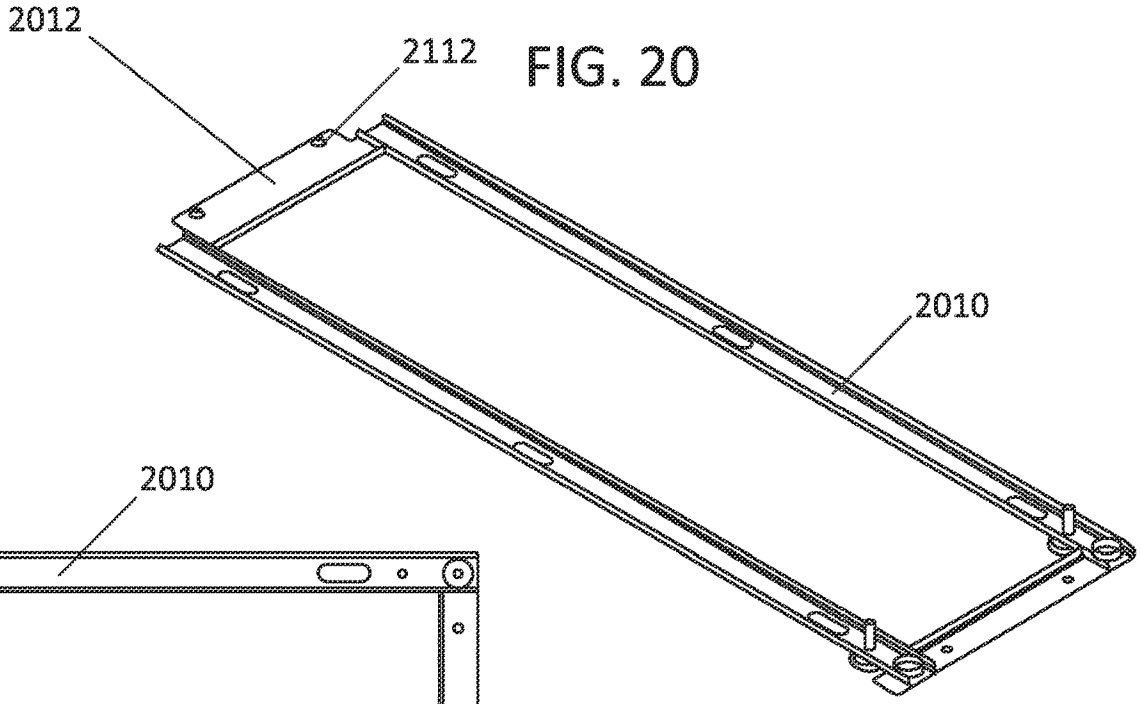
FIG. 20 shows an example additional base.
Figure 21:
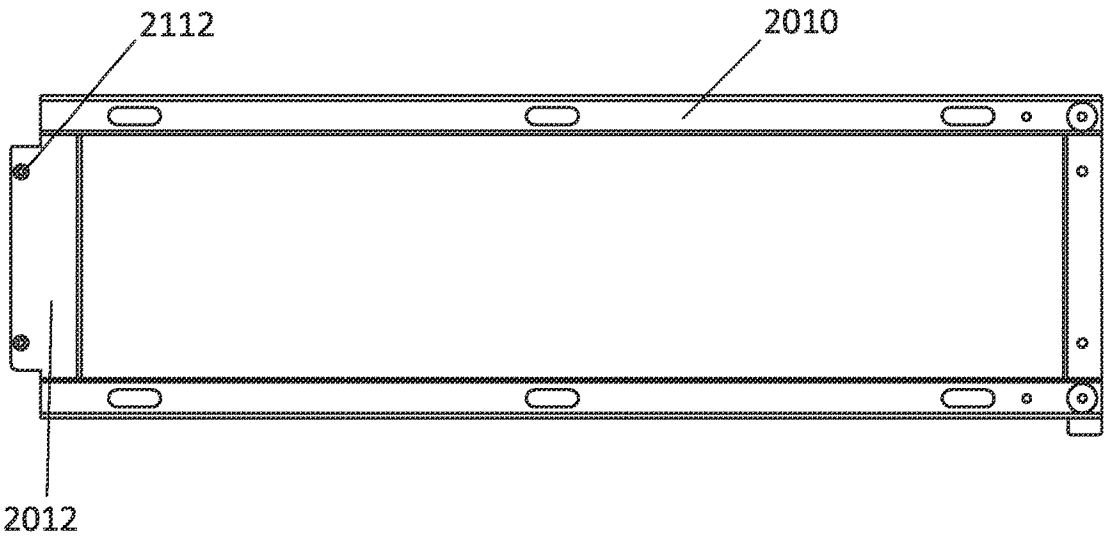
FIG. 21 shows another view of the additional base of FIG. 20.
Figure 22:
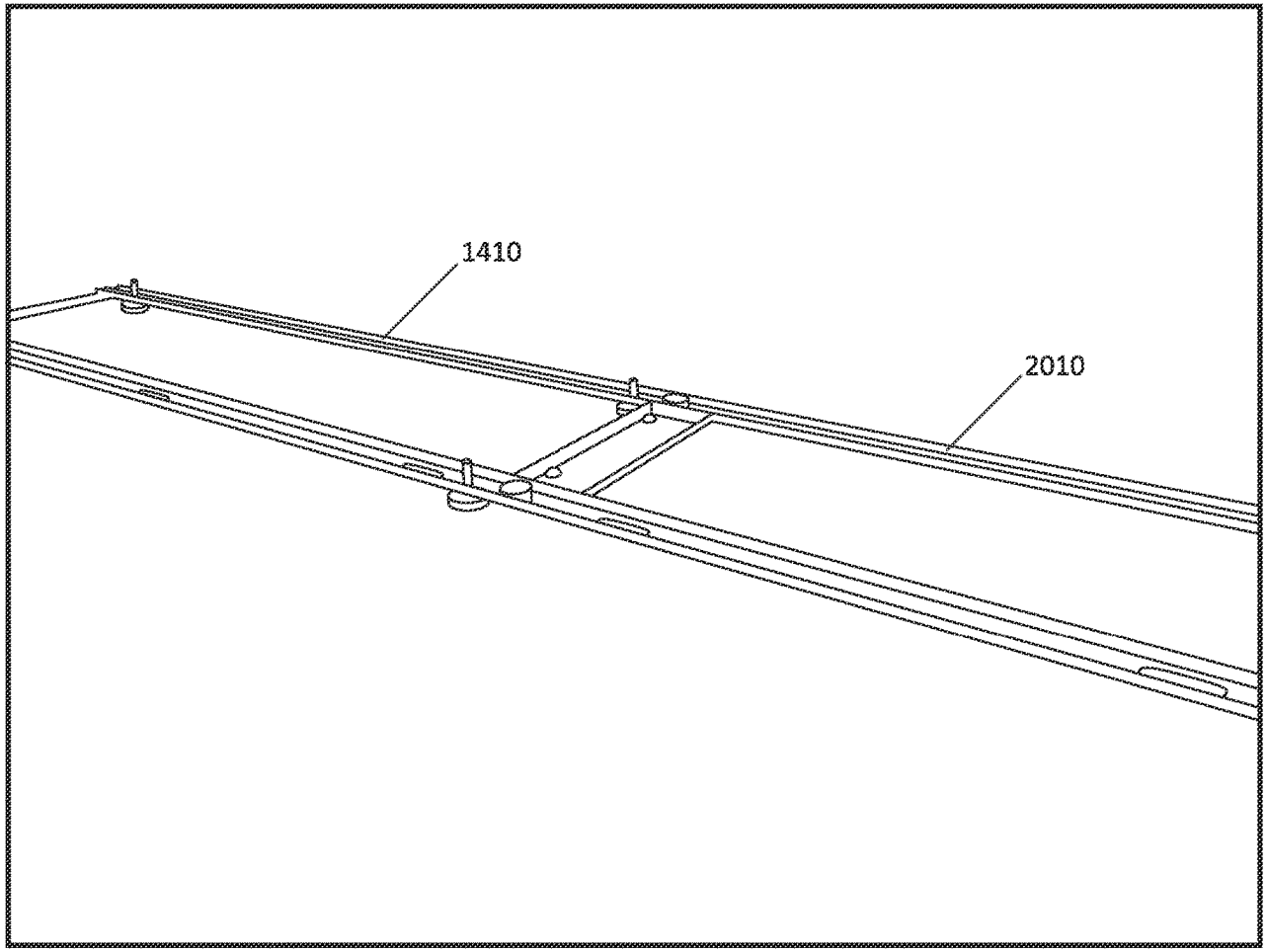
FIG. 22 shows the additional base of FIG. 20 connected to the base of FIG. 14.
Figure 23:
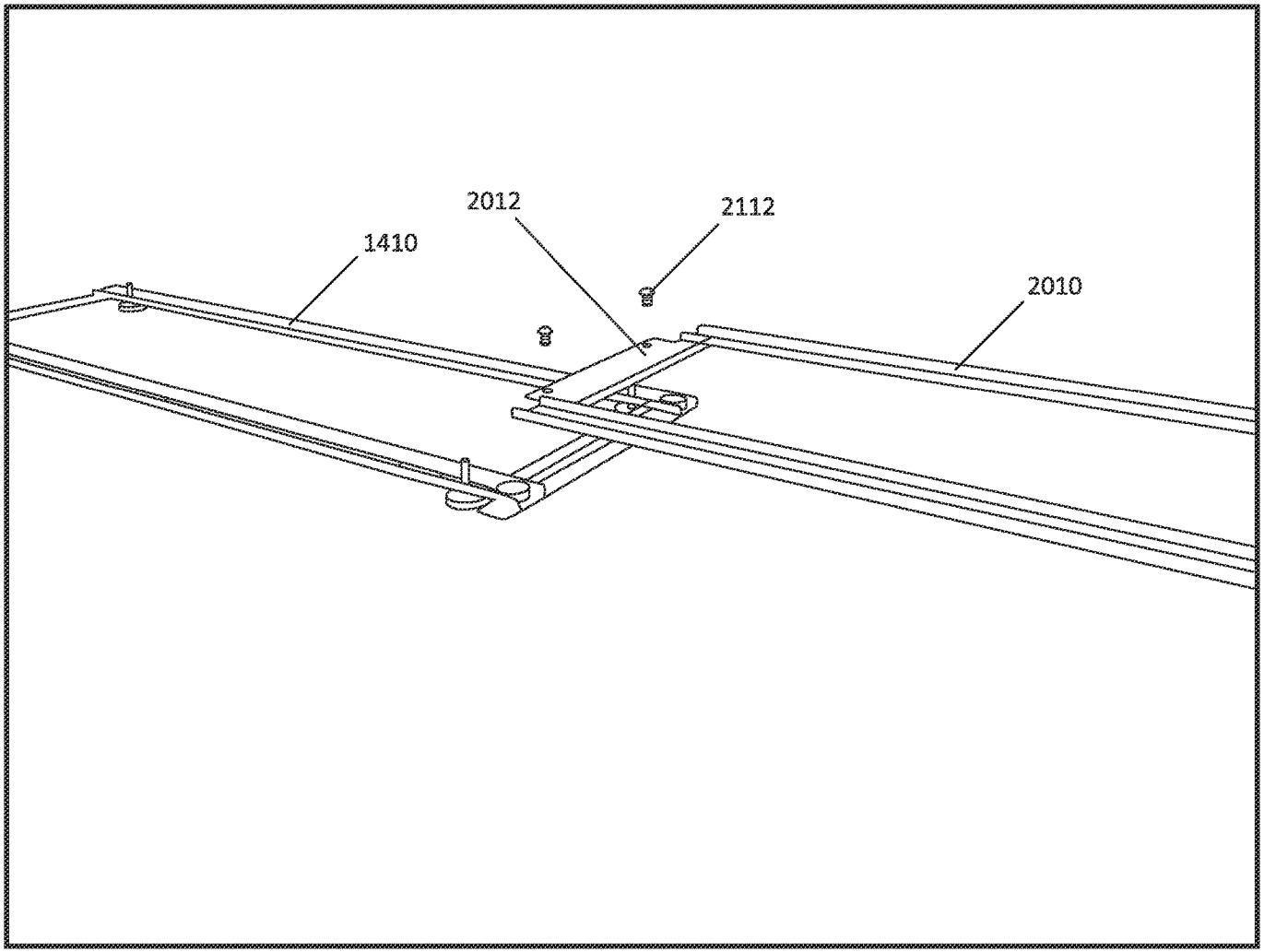
FIG. 23 shows another view of the additional base of FIG. 20 connected to the base of FIG. 14.
Figure 24:
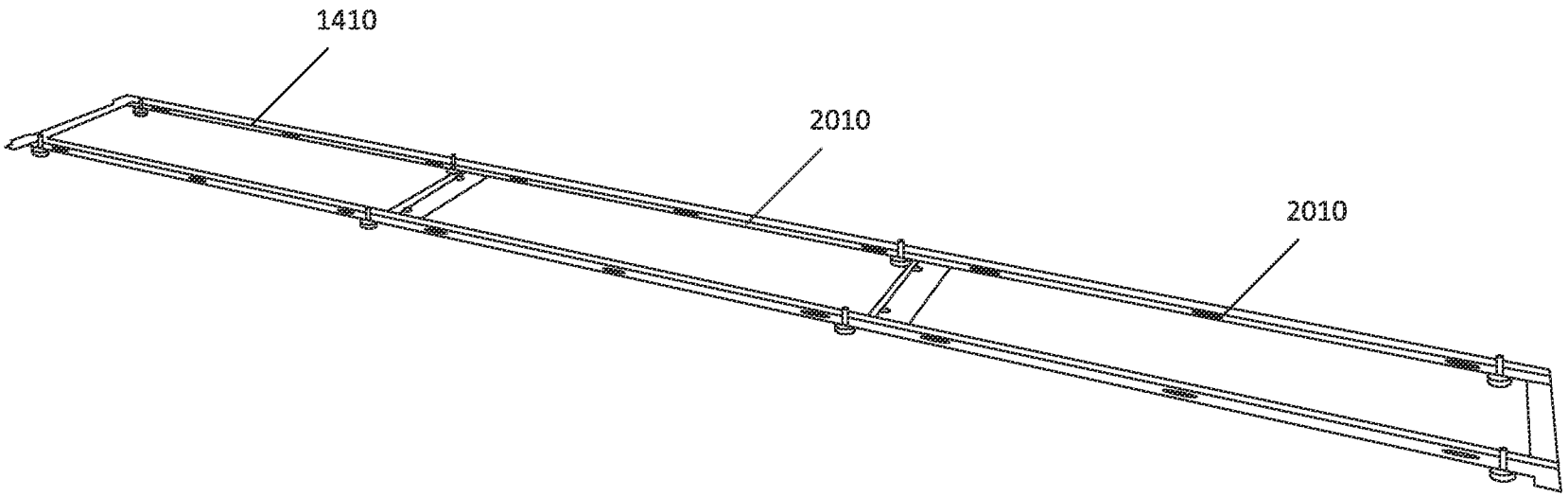
FIG. 24 shows two additional bases connected to the base of FIG. 14.
Figure 25:
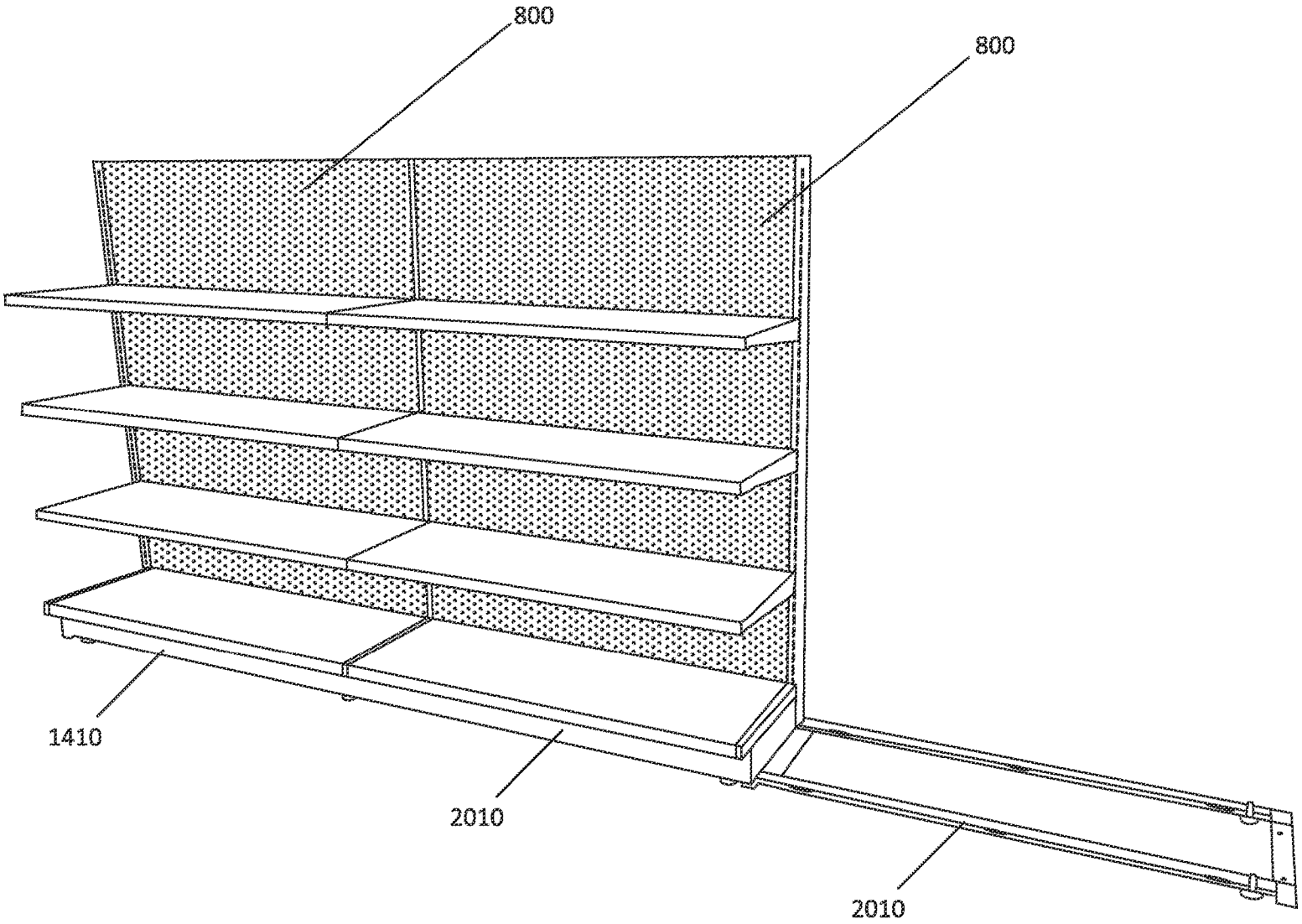
FIG. 25 shows two example gondolas positioned on one of the additional base of FIG. 20 and the base of FIG. 14.
Figure 26:
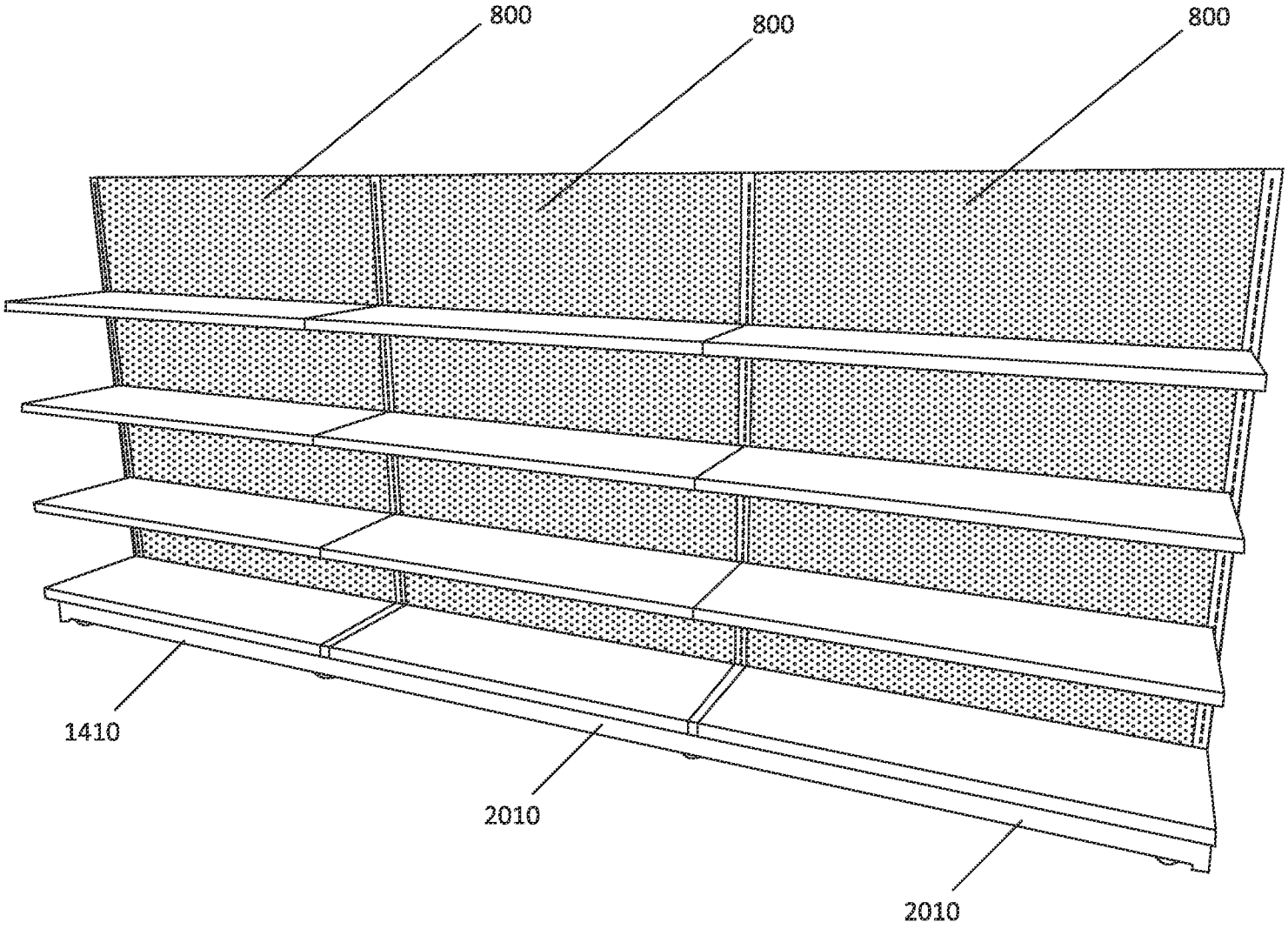
FIG. 26 shows three example gondolas positioned on the additional bases of FIG. 20 and the base of FIG. 14.

Referring now to FIGS. 1-13, a first example of base 100 is shown. The base 100 serves as a uni-body foundation under the gondola 800 (see FIG. 8), which gives the gondola 800 the additional structural integrity to allow the gondola 800 to be slid safely from location to location.

By allowing retail gondolas to be moved without disassembly and unstocking product, store floors can be easily cleaned underneath the gondola 800, and store retail plans and traffic patterns can be quickly and easily reconfigured with less staff and risk of damage to products on the gondola shelves 810.

To assemble the base 100 and gondola 800, the following steps can be performed. Initially, one selects the appropriate base frame 110 for the gondola 800 based upon the type and/or size of the gondola. The front 112 of the base frame 110 is the long side with two 1 inch tabs protruding outward from the base rails 114. The gondola 800 is built on the base frame 110, just as it would normally be built on the support surface, i.e., the floor. The feet of the gondola 800 fit precisely within the rails 114 on the base floor to create a secure fit. When positioning the toe kicks of the gondola 800 into place, they can be slid all the way down to fully hide the base 100.

Generally, the assembly process is the same, whether the gondola 800 is assembled on the store floor or on the base 100. The only considerations are to assure the base frame 110 is in the correct orientation (marked with the word "front") and that the toe kicks from the gondola 800 fully cover the rails 114 of the base frame 110 when they are slid into position.

The rails 114 included two threaded eyelets or weld nuts 120 for receiving an inverted bolt 122. The inverted bolts 122 function as "levelers" that can be threaded into and out of the eyelets 120 to level the base 100 and attached gondola 800. Specifically, each inverted bolt 122 can be (i) threaded further into the eyelets 120 of the bracket to lower a corner of the base frame, or (ii) threaded further out of the eyelets 120 of the bracket to raise the corner of the base frame.

The heads 224 of the inverted bolts 122 contact the floor, and the base 100 is held by the inverted bolts 122 above the floor. A head 224 of each inverted bolt 122 has a nylon skid/pad which glides over most flooring surfaces with minimal resistance. In example embodiments, the nylon skid/pad is molded onto or otherwise adhered to the head 224 of each inverted bolt 122. Other configurations are possible.

In example embodiments, the base 100 is fabricated in a metal fabrication facility. The parts are cut, formed, welded and finished (powder-coated). Specifically, the base frame can be a single cut, formed, welded and powder-coated unit. The base 100 requires no assembly by the user.

There can be a limited number of versions of the base 100, selected based upon which size/type of gondola will be built upon it. For example and without limitation, there are generally two widths of gondola (36 inch and 48 inch), and the width of the base is sized accordingly. Optionally, a base having a nominal width of 96 inches that holds two gondolas together can be provided. There are also multiple depths for gondolas, and the base depth can be customized based on particular shelf-depth needs and layouts.

Referring now to FIGS. 14-28, an example of a system 1400 is shown.

The system 1400 is comprised of a "starter" base 1410, which is a self-contained, stand-alone frame 1412. The base 1410 is similar to the base 100 described above. However, the bolts 1420 are threaded through eyelets 1422 formed in the frame 1412 itself. Further, the base 1410 includes example circular locators 1430 that are positioned to accept the feet of the gondola 800 placed onto the base 1410 to locate the gondola 800 on the frame 1412.

A single base 1410 is shown in FIGS. 14-19. In some embodiments, multiple bases can be connected in series or parallel to receive gondolas of larger dimensions.

Figure 27:
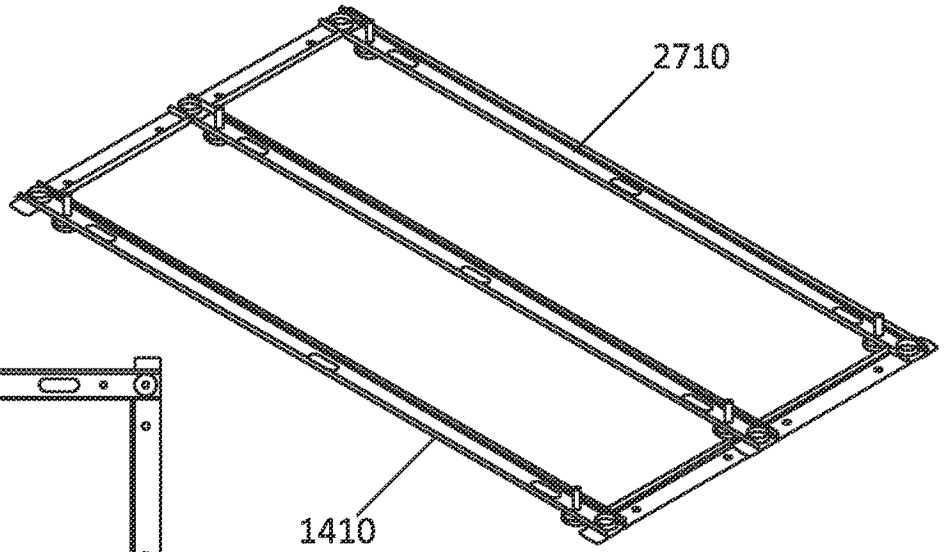
FIG. 27 shows another view of the base of FIG. 14 connected to an additional base.
Figure 28:
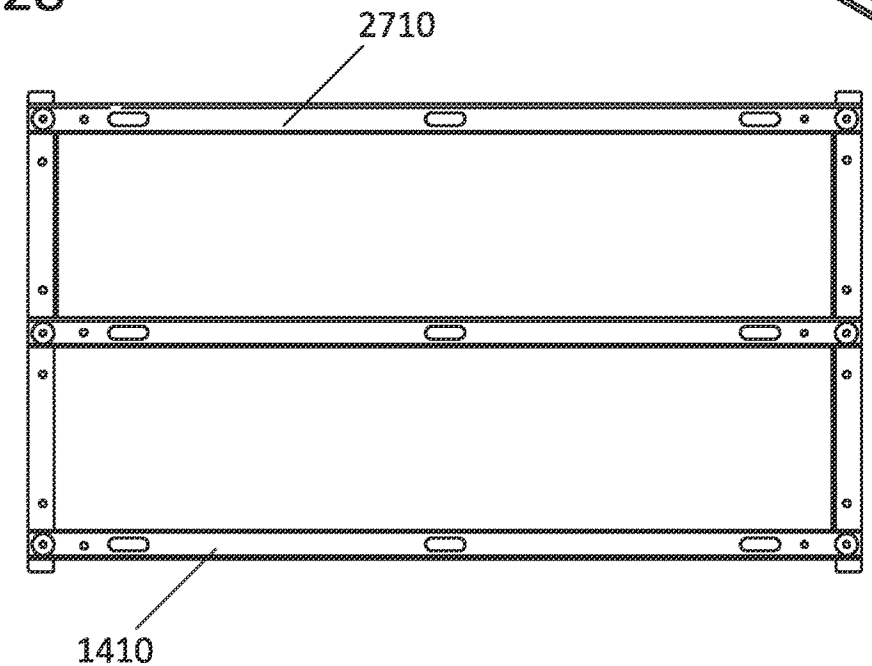
FIG. 28 shows another view of the base of FIG. 14 and the additional base of FIG. 27.

For instance, one or more "adder" bases 2010 can be attached to the starter base 1410, allowing multiple 36" or 48" gondolas to be joined together in series. See FIGS. 20-28. The unique characteristic of the adder bases 2010 is that each adder bases 2010 has two bolts 1420. When attached by a portion 2012 with bolts 2112 and weld nuts to a starter base 1410 or another adder unit 2010, the adder base 2010 relies upon two feet from unit it attaches to, to form the fully functional base frame. See, e.g., FIG. 23. Similarly, the starter base 1410 can be connected in parallel to an adder base 2710, as shown in FIGS. 27-28.

Many other configurations beyond the examples provided herein are possible.

What is claimed is:

1. A base for a retail gondola, the base comprising:

a frame defining a locator, the locator being configured to receive a bottom portion of the retail gondola therein;

a plurality of bolts held by the frame, the plurality of bolts being moveable up and down to position the frame relative to a support surface; and inner and outer rails extending upwardly from an upper surface of the frame and extending along a substantial length of the frame, the inner and outer rails defining a channel between the inner and outer rails for receiving the bottom portion of the retail gondola;

wherein a portion of each of the plurality of bolts is configured to allow the frame to be slid along the support surface when the retail gondola is received within the frame.

2. The base of claim 1, wherein each of the plurality of bolts is threaded into the frame.

3. The base of claim 1, wherein each of the plurality of bolts defines a head surface configured to slide along the support surface.

4. The base of claim 1, further comprising a plurality of locators, with each of the plurality of locators being configured to receive the retail gondola.

5. The base of claim 4, wherein each of the plurality of locators is circular.

6. The base of claim 1, wherein the base is configured to be connected with another base.

7. A system, comprising:

a stand-alone retail gondola;

a base for the stand-alone retail gondola, the base comprising:

a frame defining a locator, the locator being configured to receive a bottom portion of the stand-alone retail gondola therein, the bottom portion including a foot of the stand-alone retail gondola, with the foot being received in the locator;

a plurality of bolts held by the frame, the plurality of bolts being moveable up and down to position the frame relative to a support surface; and inner and outer rails extending upwardly from an upper surface of the frame and extending along a substantial length of the frame, the inner and outer rails defining a channel between the inner and outer rails for receiving the bottom portion of the stand-alone retail gondola;

wherein a portion of each of the plurality of bolts is configured to allow the frame to be slid along the support surface when the stand-alone retail gondola is received within the frame.

8. The system of claim 7, wherein each of the plurality of bolts is threaded into the frame.

9. The system of claim 7, wherein each of the plurality of bolts defines a head surface configured to slide along the support surface.

10. The system of claim 7, further comprising a plurality of locators, with each of the plurality of locators being configured to receive the stand-alone retail gondola.

11. The system of claim 10, wherein each of the plurality of locators is circular.

12. The system of claim 7, wherein the base is configured to be connected with another base.

13. A method for supporting a stand-alone retail gondola, the method comprising:

providing a base for the stand-alone retail gondola, the base including:

a frame defining a locator, the locator being configured to receive a bottom portion of the stand-alone retail gondola therein, the bottom portion including a foot of the stand-alone retail gondola, with the foot being received in the locator; and inner and outer rails extending upwardly from an upper surface of the frame and extending along a substantial length of the frame, the inner and outer rails defining a channel between the inner and outer rails for receiving the bottom portion of the stand-alone retail gondola;

positioning a plurality of bolts held by the frame, the plurality of bolts being moveable up and down to position the frame relative to a support surface; and allowing a portion of each of the plurality of bolts to be slid along the support surface when the stand-alone retail gondola is received within the frame.

14. The method of claim 13, further comprising threading each of the plurality of bolts into the frame.

15. The method of claim 13, wherein each of the plurality of bolts defines a head surface configured to slide along the support surface.

16. The method of claim 13, further comprising providing a plurality of locators, with each of the plurality of locators being configured to receive the stand-alone retail gondola.

17. The method of claim 13, further comprising connecting the frame with another base.

* * * * *